US005805066A

United States Patent [19]

Murdy

[11] Patent Number: 5,805,066

[45] **Date of Patent: *Sep. 8, 1998**

[54] INSTRUMENT CASE AND ALARM

[76] Inventor: Dwight Murdy, HCR 1, Box 314, Lampe, Mo. 65681

[ * ] Notice: The terminal 12 months of this patent has been disclaimed.

[21] Appl. No.: 458,500

[22] Filed: Jun. 2, 1995

[51] Int. Cl.[6] ..... G08B 13/14

[52] U.S. Cl. ..... 340/568; 200/85 R; 206/314; 340/529; 340/539; 340/571; 340/666; 343/720

[58] Field of Search ..... 340/571, 568, 340/572, 666, 539, 545, 529; 200/85 R, 61, 62; 206/314, 14; 70/58, 63; 343/720, 906; 455/66, 95, 128

[56] References Cited

U.S. PATENT DOCUMENTS

| | | | |
|---|---|---|---|
| 4,117,468 | 9/1978 | Vasquez | 340/571 |
| 4,267,553 | 5/1981 | Vogelsanger et al. | 340/571 |
| 4,337,462 | 6/1982 | Lemelson | 340/572 |
| 4,728,937 | 3/1988 | Hsu | 340/571 |
| 4,843,371 | 6/1989 | Kuei et al. | 340/539 |
| 5,001,460 | 3/1991 | Basson | 340/571 |
| 5,025,704 | 6/1991 | Davis | 455/95 X |
| 5,041,815 | 8/1991 | Newton | 340/568 |

*Primary Examiner*—Thomas Mullen
*Attorney, Agent, or Firm*—Stephen D. Carver; Trent C. Keisling

[57] ABSTRACT

An instrument case and alarm is disclosed that provides a reliable alarm system that selectively uses audio, visual and radio alerts to attract attention to the case and instrument. In one preferred embodiment, the alarm emits a separate and distinct audible alarm if the instrument is removed from the case. The case comprises housing that protectively encloses the instrument. A door hinged mounts the housing to provide access therein. Several feet project from the housing to support the case. The alarm mounts inside the housing. A primary set switch penetrates the instrument case housing and the alarm frame. This primary switch is preferably key-operated. The switch sets the alarm. Preferably, my alarm has a selective down time. The alarm uses several triggers to sense detonation stimuli. The case trigger comprises two separately actuable sensor arrays. Preferably, at least one sensor on each array penetrates a case foot. Another trigger detects motions of the case. Another trigger detects case openings. The alarm uses a programmable alert system to attract attention to the case. The alert system comprises audio, visual and radio wave transmitters. In one preferred embodiment, a separate trigger independently detonates a separate audible alert if the instrument is removed from the case.

9 Claims, 5 Drawing Sheets

INSTRUMENT CASE AND ALARM

BACKGROUND OF THE INVENTION

I. Field of the Invention

The present invention relates generally to instrument carrying cases. More particularly, the present invention relates to a musical instrument carrying case equipped with a programmable security alarm. Known relevant prior art can be found in U.S. Class 206, Subclasses 14 and 314, and U.S. Class 340, subclass571.

II. Description of the Prior Art

As will be immediately recognized by those skilled in the art, musical instruments are often expensive and valuable objects. Instrument cases are widely used for protecting these valuable objects during transportation and/or storage.

Typical instrument cases often contain locking clasps that protect the case itself against unauthorized opening. To some extent, these locking clasps provide some degree of protection for the instrument contained inside the case.

However, the working environment of many musicians, especially those performing "live," often lends itself to thievery. Guitars are frequently used by musicians in bands which perform in crowded, dark bars or similar arenas. As a result, many thieves find the musical instruments and cases tempting and relatively simple marks.

It has been recognized in the art that it is desirable to provide an alarm system for portable containers to prevent the theft of the container. But the known prior art does not adequately address the special needs of musicians.

Known prior art relevant to my invention can be broken into two basic categories. The first category involves satchel or case alarms that are designed to prevent the unauthorized removal of the case from a courier or other person's possession. Such alarms are activated by the removal of the courier's hand from the case handle. Alarms of this type are shown in U.S. Pat. Nos. 1,119,193, 5,184,110 and 3,832,705. Interestingly, U.S. Pat. No. 1,119,193 teaches the use of a hidden firearm to prevent the theft of the case.

The other category utilizes alarms that are detonated when the case or other protected object is moved. Examples of these types of alarms are seen in U.S. Pat. Nos. 1,171,042, 4,267,553, 5,148,150, 3,685,037, 2,797,405 and 4,117,468.

However, both categories of these prior art devices fail to address several problems peculiar to musical instruments. An ideal alarm for instrument cases should protect both the instrument and the case in several complementary ways.

First, the alarm must sense movement or disturbance of the case by a would-be thief. The alarm system would need several different triggers to function properly. One trigger would detonate the alarm if the case was shifted or dislodged. Another trigger would detonate the alarm if the case were opened by a thief. A third trigger would detonate the alarm if the instrument was removed from the case.

Importantly, the instrument case is often not as valuable as the instrument itself. In other words, the musical instrument generally costs much more than the case in which it is kept.

It is not uncommon for the musical instrument to be a starving artists only means of making a living. Often, artists leave their musical instruments unattended in open cases. Therefore, it is desirable to provide a separate alarm that is detonated when the valuable instrument is removed from its case.

The alarm should provide two separate tones to indicate the removal of the musical instrument from the case. Thus, the owner would be able to rapidly begin searching for the musical instrument apart from the case.

Preferably, an ideal musician's alarm would emit both audible and visual signals upon detonation. The dual signals would expedite the owner's search for the instrument and case in a dark and/or crowded room. The ideal alarm should also emit a silent radio signal that could also be used as homing signal. A radio transmission would be ideal because direction-finding radio receivers are well-known and readily available.

A radio transmitter would be particularly desirable because it could also function as a beacon. Such a beacon would permit the owner to track the case without the thief's knowledge. An ideal alarm would utilize the instrument itself as an antenna for a radio transmission that could be tracked.

SUMMARY OF THE INVENTION

My instrument case and alarm provides a reliable alarm system that uses both audio and visual alarms to alert the owner that the case has been tampered with or moved. My alarm also provides a radio transmitter that signals the owner silently. The radio transmitter also functions as a beacon that allows the owner to track the case if it is stolen or moved. Additionally, in one preferred embodiment, the alarm emits a separate and distinct audible alert if the instrument is removed from the case.

Generally, the instrument carrying case is a simple housing that protectively encloses the instrument. A door often hinged mounts upon the housing to provide access to the housing interior. In use, the door facilitates the insertion and removal of the instrument inside the case.

In most instrument cases, several feet project from the housing to support the case when it is set upon a surface. These feet may project from one surface or may project from two different surfaces if the case is designed to be supported or used in variable configurations (i.e., guitar cases).

The alarm mounts inside the housing. The alarm has a frame that protectively encloses a circuit board and a power supply. A primary set switch penetrates the instrument case housing and the alarm frame. This primary switch is preferably key-operated. The switch sets the alarm.

Preferably, my alarm has a selective down time. In other words, once the switch is turned on, the alarm sets after a preselected time period passes. This permits the owner to turn the switch on to set the alarm and then adjust the instrument case or remove the instrument without detonating the alarm. The owner may select the time period that passes before the alarm sets.

The alarm uses several triggers to sense detonation stimuli. The case trigger comprises two separately actuable sensor arrays. Preferably, at least one sensor on each array penetrates a case foot. In this manner, the sensor is hidden to prevent its detection by a thief. This sensor detonates the alarm when the case is picked up.

Another sensor detects motions of the case. This sensor detonates the alarm when the case is moved. Yet another sensor detonates the alarm if the case is opened.

The alarm uses a programmable alert system to protect the case. The alert system comprises several different signals that attract attention to the case and instrument when the alarm is detonated.

One of the alerts is an audio signal, such as a bell or warning siren. The second alert is a visual signal, such as a strobe light or spotlight. The third alert is a silent alarm or homing beacon that uses radio waves to emit a signal.

A separate instrument trigger uses a sensor to detect movements of the instrument. This trigger independently detonates when the instrument is removed from the case. When this trigger detonates the alarm, a separate audible alert is activated that attracts attention to the instrument itself.

Thus, a primary object of my invention is to provide a fail-safe alarm system for instrument cases.

A broad object is to provide a convenient burglar alarm system for instrument cases, particularly cases used for guitars and other stringed instruments.

A more exacting object is to provide a convenient and easy to use alarm for guitar cases.

Another object is to provide a case alarm of the character described with triggers that can not be seen from the exterior by unknowing thieves.

Still another object is to provide a delay system in the case alarm of the character described which gives the user ample time to "park" his empty guitar case and remove the instrument, or remove the instrument without detonating the alarm.

A still further object is to provide an alarm of the character described which responds to excessive vibration, sudden shocks, tilting or tipping over and the like.

Yet another object is to provide a guitar case alarm or music instrument alarm of the character described which provides electrical access to external alarms.

Another object is to provide a system of the character described wherein the actuating push switches are concealed and are not externally visible.

A still further object is to provide a battery system for an alarm of this character which can be recharged conveniently.

Yet another important object is to provide a visual warning of alarm detonation.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
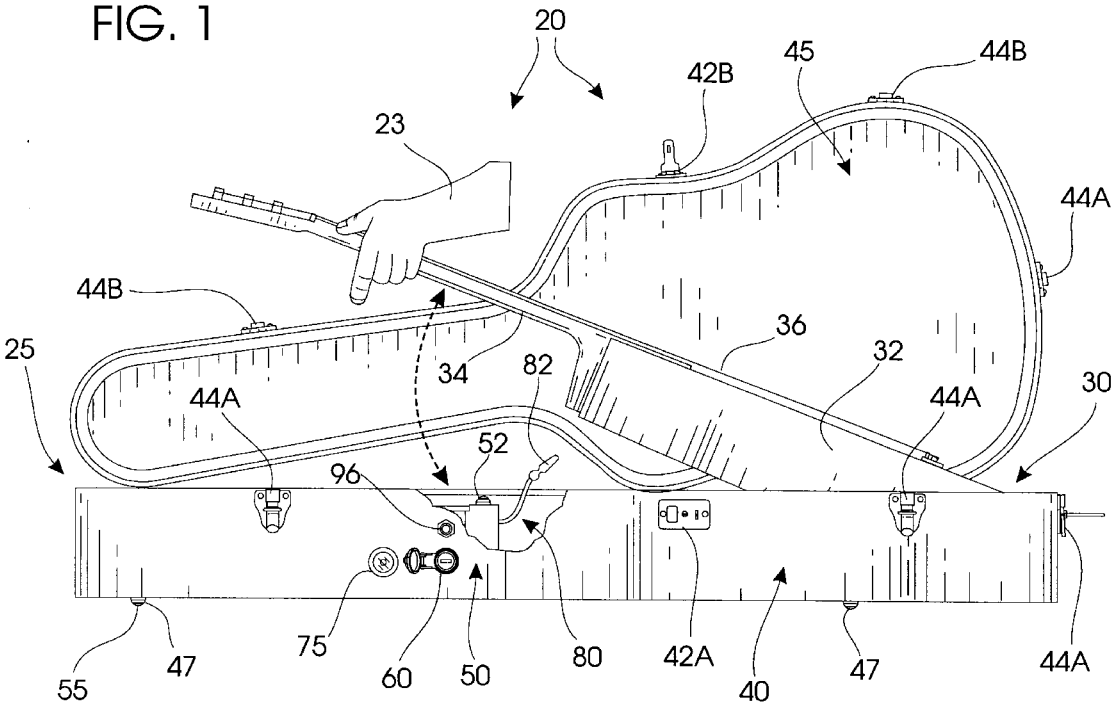
FIG. 1 is a partially fragmented, side elevational environmental view of the preferred instrument case, depicting the movement of the instrument therefrom, with portions thereof broken away for clarity.
Figure 2:
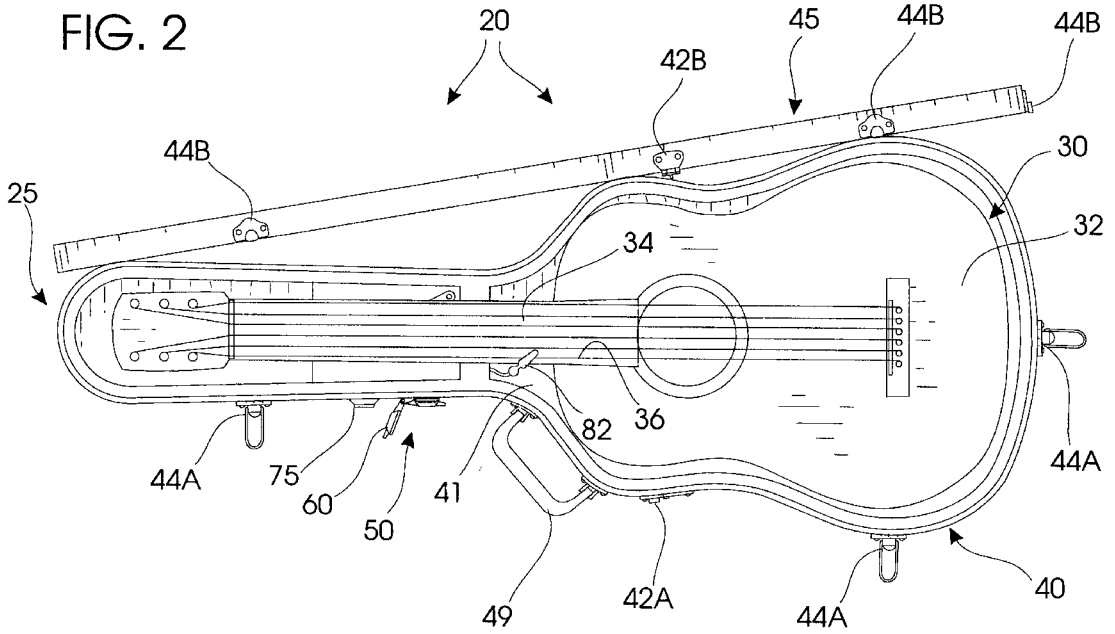
FIG. 2 is a top plan view of my instrument case and alarm showing a preferred embodiment thereof, with a stringed instrument inside the case, and with the door opened.
Figure 3:
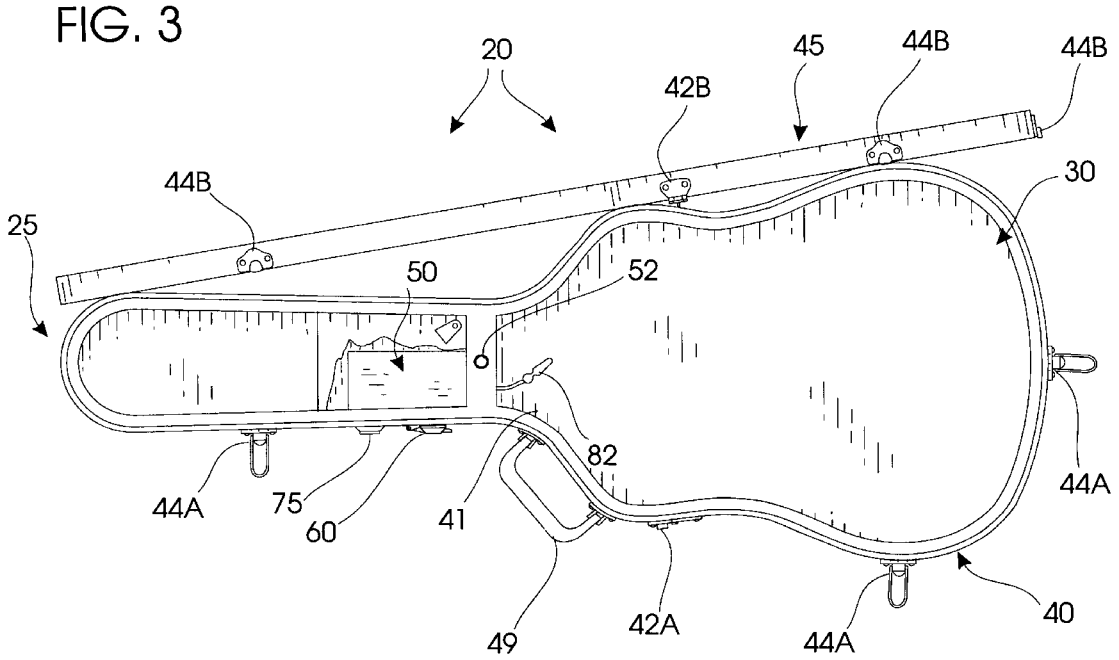
FIG. 3 is a partially fragmented, top plan view similar to FIG. 1, with the instrument removed and with portions broken away to show the alarm frame mounted inside the housing.

Referring more specifically to the drawings, my instrument case and alarm is generally designated by reference numeral 20. The instrument case is designated by reference numeral 25. Instrument case 25 commonly protectively encloses an instrument 30 (FIGS. 1–4). In a conventional guitar case, the case protects the instrument body 32, neck 34 and strings 36.

The case comprises a housing 40 and an access lid or door 45. The door 45 may be selectively opened to gain access to the housing interior 41. This permits the removal of instrument 30 therefrom by a person 23. Door 45 attaches to the housing 40 with hinges 46 (FIG. 4) that are spaced along the housing periphery.

Several latches secure the door 45 to the housing 40. A locking latch 42 prevents the unauthorized opening of the case 25. Additional latches 44 secure the door 45 at spaced apart intervals. Each latch 44 comprises a lower latch 44A attached to the instrument housing 40 and an upper latch 44B attached to the door 45.

Figure 4:
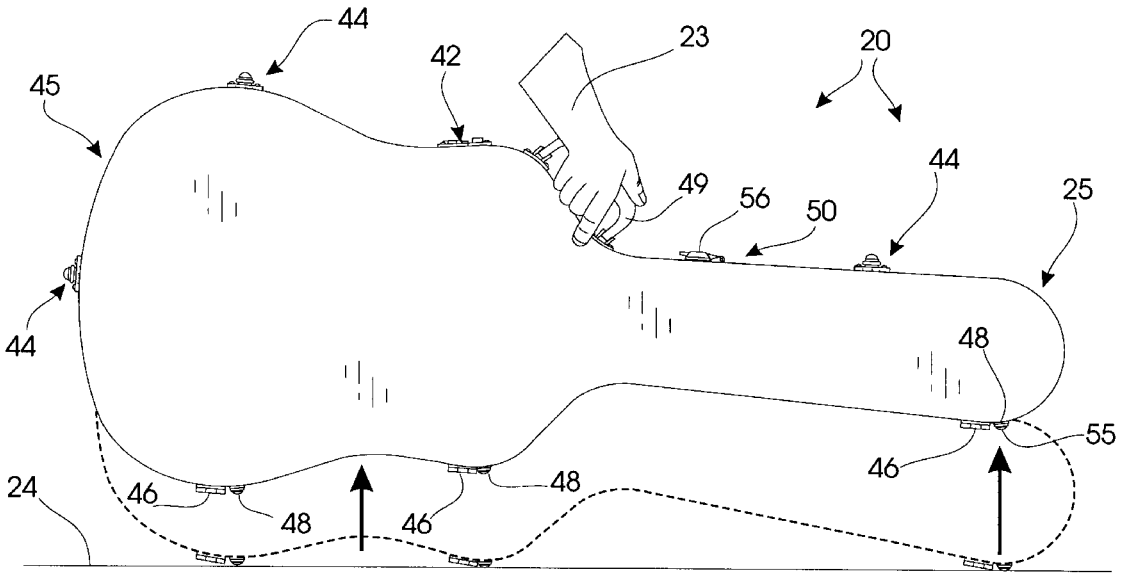
FIG. 4 is an environmental view of my instrument case showing the case being lifted from a support surface, with dashed lines showing movement.
Figure 5:
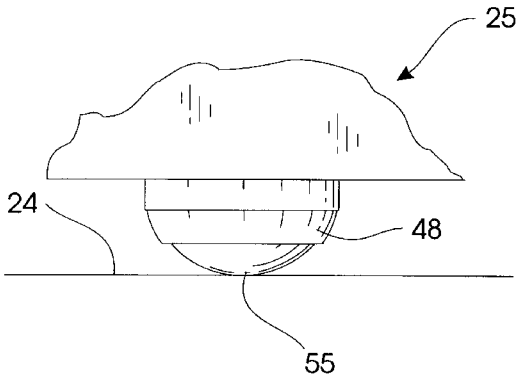
FIG. 5 is a greatly enlarged, fragmentary view of the preferred case foot with the sensor depressed.
Figure 6:
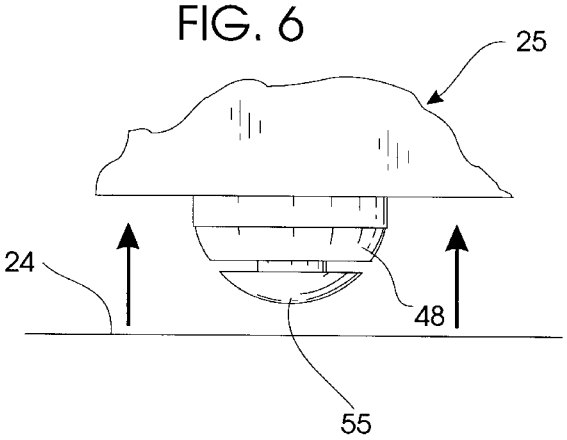
FIG. 6 is a greatly enlarged, fragmentary view similar to FIG. 5, showing the detonation position of the sensor.
Figure 7:
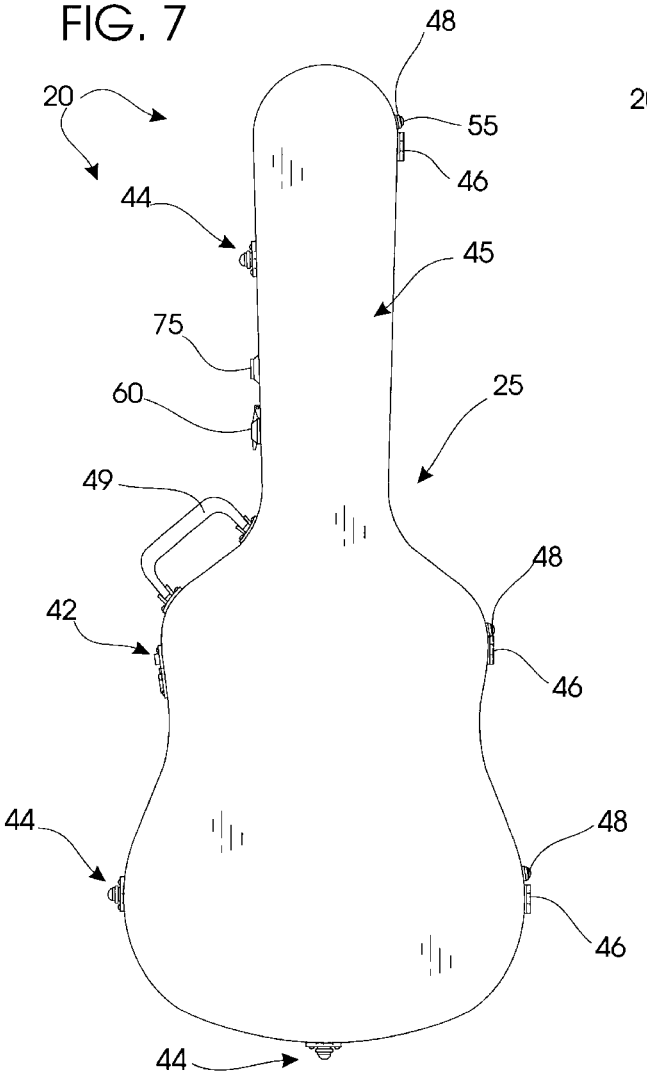
FIG. 7 is a top plan view of the instrument case with the door closed.
Figure 8:
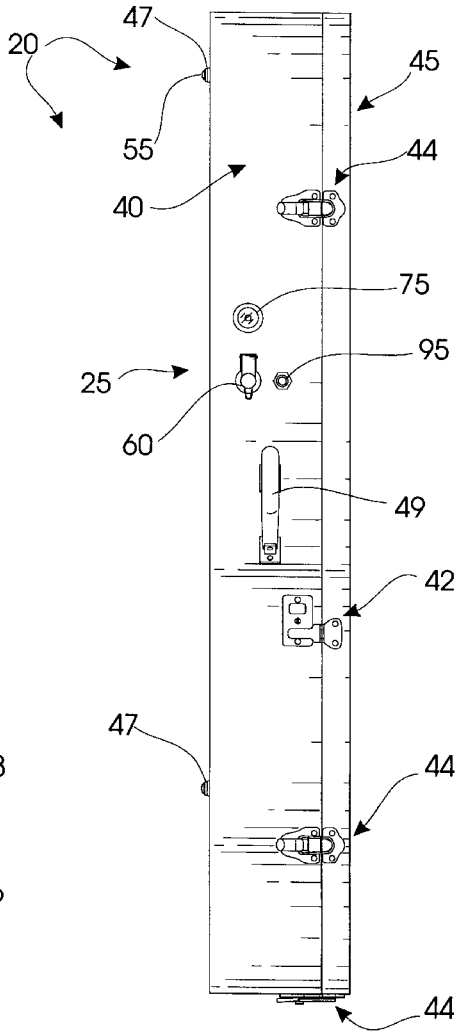
FIG. 8 is a side elevational view of the instrument case with the door closed.

Several feet 47 project outwardly from housing 40 to support the case upon a surface 24. On most conventional cases, these feet 47 project from the bottom portion of the case. On various types of these conventional cases, additional feet 48 project from other portions of the case to facilitate alternative case placements (FIGS. 1 and 4). A handle 49 facilitates grasping of the case by a person.

In one preferred embodiment of the invention, an instrument trigger or sensor 52 mounts on the housing interior 41 to detect the presence, absence or removal of the instrument 30 contained therein.

The alarm 50 protects the case 25 against theft. The alarm 50 is mounted in the housing interior 41. Several conventional, external case triggers 55 detonate the alarm 50 when they are tripped. Since these types of devices are well known in the art, they are not described in detail. Triggers 55 respond to various detonation stimuli.

Preferably, at least one of the triggers 55 penetrates one of the feet 47, 48. The penetrated foot may be any of the feet projecting from the housing 40 and may be in any number of combinations. In other words, any number of triggers may project from a corresponding number of the feet 47, 48. In this manner, these triggers are hidden, preventing their detection by a thief. These triggers detonate the alarm when the case is picked up.

Another trigger detects motions of the case. This trigger detonates the alarm when the case is moved. Yet another trigger detonates the alarm if the case is opened.

The alarm 50 is armed or set by manipulating a key operated switch 60. The switch 60 controls a circuit board 100 that drives the alarm 50. Preferably, the switch uses a delay mechanism. The delay enables the user to turn the alarm on and position the case or remove the instrument without triggering the alarm. Once set, movement of the case or the instrument therefrom would trigger the alarm.

Once the alarm is detonated, it emits an alert signal to attract attention to the case and instrument. The alert signal may be in the form of audio or visual or radio transmission waves. Preferably, the alarm uses a programmable alert system that permits the user to selectively enable the various types of alerts.

Figure 9:
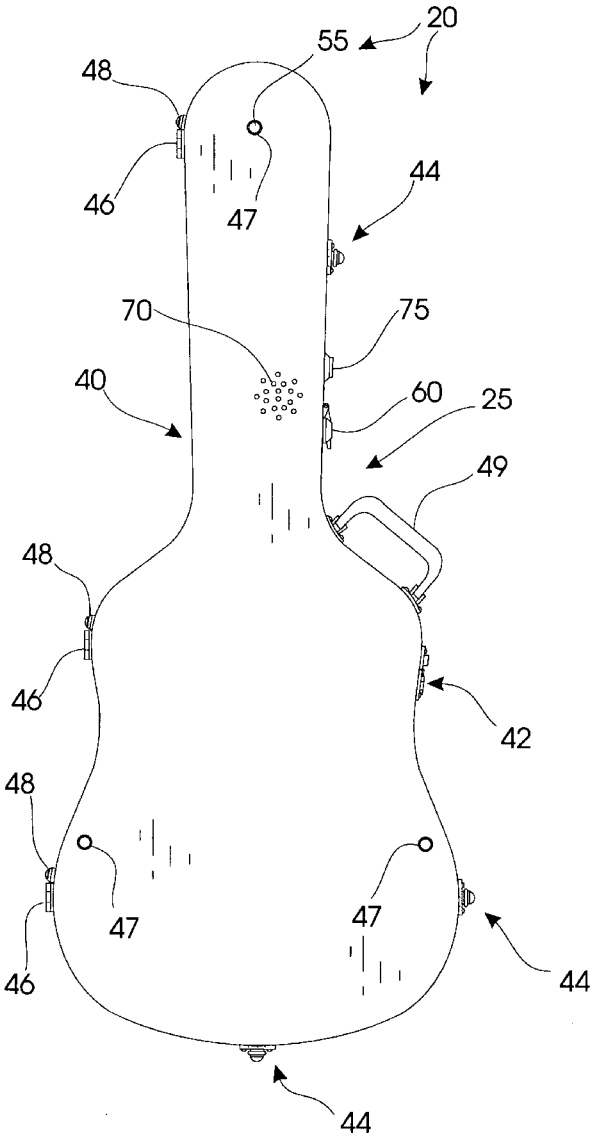
FIG. 9 is a bottom elevational view of the instrument case.
Figure 10:
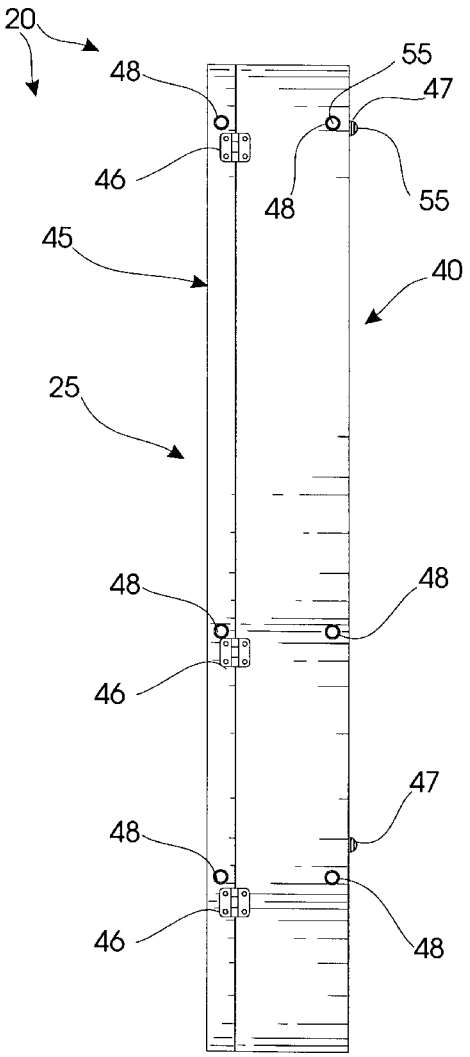
FIG. 10 is a side elevational view of the instrument case taken from a position to the rear of that illustrated in FIG. 8; and, FIG. 11 is an electrical schematic diagram of a preferred circuit for the alarm.

In the preferred embodiment, a siren selectively emits a loud, audio alarm through speaker port 70 (FIG. 9). A strobe light 75 selectively emits a flashing visual signal.

In one preferred embodiment, a radio lead 80 facilitates the transmission of radio waves from the guitar string 36. Radio lead 80 attaches to the strings 36 via alligator clip 82. The strings 36 form an antenna that facilitates the radiation of radio waves therefrom.

In another preferred embodiment of the present invention, sensor 47 detonates a separate alert that comprises a distinctive audio signal when the instrument is removed from the case. In this manner, the owner will immediately know that the instrument has been removed from the case. In another contemplated embodiment of the present invention, the siren 70 could selectively emit a separate tone in response to detonation of sensor 47.

Figure 11:
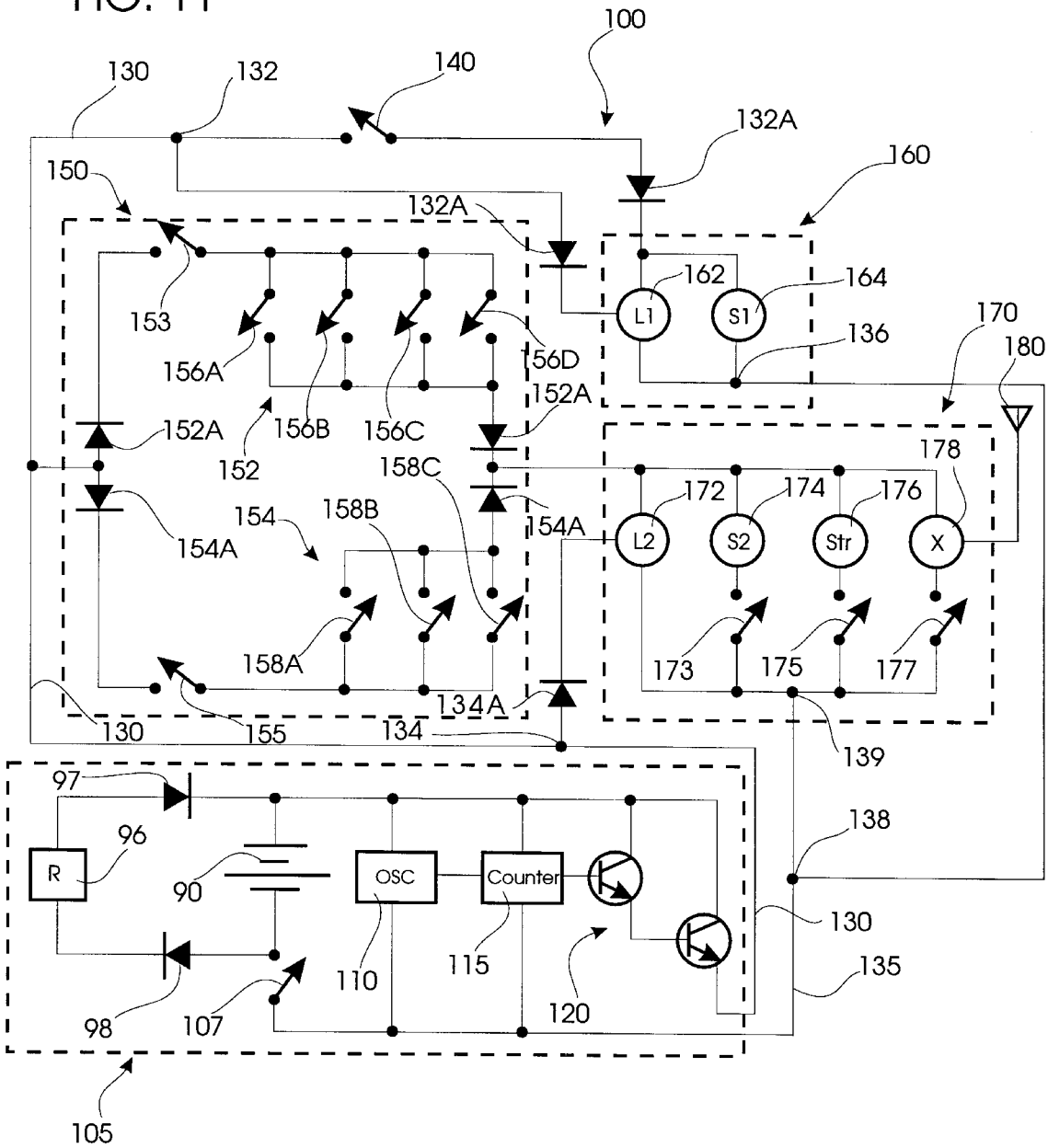

The alarm 50 is preferably powered by a battery pack 90 or similar rechargeable power source (FIG. 11). The battery pack 90 may be recharged using recharge socket 95 through recharger 96. Appropriate diodes 96, 98 isolate the recharger.

The battery electrically drives circuit 100 through solid state switch assembly 105. An arming switch 107 mounted to the circuit board controls the operation of the alarm 50. Switch 107 initializes oscillator 110 that drives counter 115. Counter 115 provides a delay feature so that after the apparatus is armed, the user has a short time to place the apparatus and move it without detonating the alarm. When counter 115 times out, it activates a Darlington driver circuit that energizes line 130. Main electrical switch 107 is operatively connected and controlled by the external mechanical switch 60. Preferably, the delay time period is variable by the user. When the selected time period has passed, voltage applied by Darlington circuit 120 to line 130 is available to the rest of the alarm.

Trigger circuits 140 and 150 respond to line 130. They can activate alert circuits 160 and 170 respectively. Appropriate isolating diodes 132A, 134A ensure the proper directional flow of electric current through alerts 160, 170. A return line 135 connects from the alert circuits 160, 170 to complete the circuit 100. Line 135 returns from alert 160 via junction 136 and is joined at junction 138 by the return from alert 170 via junction 139.

Once the alarm 50 is set, power is supplied to sensor 140 and trigger 150. Sensor 140 detects removal of the instrument from the case, and is normally in physical contact with the instrument. Sensor 140 detonates alert 160 when tripped.

Alert 160 comprises latch 162 and siren 164. Latch 162 provides continuous power to the alert once sensor 140 trips, being connected to line 130. Siren 164 generates loud noises to attract immediate attention to the instrument contained in the case. Preferably, the siren comprises a piezoelectric generator capable of emitting loud, external audio signals.

Trigger 150 comprises two separately actuable, programmable arrays 152, 154 of sensors. Power is delivered through isolating diodes 152A, 154A to arrays 152 and 154 respectively. A switch 153 permits the user to selectively enable array 152. A similar switch 155 permits the user to selectively enable array 154. Array 152 may include mechanical feet 47 (FIG. 1) projecting from the flat rear side of the case. Array 154 may include mechanical push switches 48 (FIG. 4) projecting from the narrower bottom of the case. Selection of the right array depends upon the preferred orientation of the case.

Array 152 (FIG. 11) comprises sensors 156A–D and array 154 comprises sensors 158A–C. These switch sensors are externally mounted inside the case feet, or attached to locking latch 42. They may comprise mercury motion switches or detectors or other suitable switching devices. Preferably, at least one of the sensors on each array 152, 154 is hidden inside at least one of the case feet 47, 48. Appropriate wiring extends from circuit 100 to connect any external sensors and/or the various alerts to connect them to circuit 100.

Trigger 150 thus detects movement of the case 25. Trigger 150 detonates alert 170 when tripped.

Programmable alert 170 comprises latch 172, siren 174, strobe 176 and radio transmitter 178. Latch 172, which is connected to line 130, provides continuous power to the alert once trigger 150 trips.

Siren 174 sounds loud noises to attract immediate attention to the case. Preferably, the siren comprises a piezoelectric generator capable of emitting loud, external audio signals that sound different than siren 164. A switch 173 permits the user to selectively enable siren 174.

Strobe 176 emits a flashing visual signal that enables the owner to see the case in dark rooms. A switch 175 permits the user to selectively enable strobe light 176.

Radio transmitter 178 is a simple, commercially available package that generates less than 100 milliwatts of power, so no FCC license is required per Part 15 of the FCC regulations. It generates a radio transmission outputted via antenna lead 180. A switch 177 permits the user to selectively enable radio transmitter 178. Preferably, antenna lead 180 attaches to the metallic strings of the guitar, or to the metallic body of the instrument. In one preferred embodiment, the lead 180 attaches to the instrument strings to radiate radio waves therefrom, which function as an elongated antenna.

Operation

The instrument case and alarm 20 protects the case 25 and instrument 30 from theft. The case 25 protectively encloses the instrument 30 and an alarm 50.

The alarm 50 uses several triggers 55 to sense detonation stimuli. Preferably, at least one trigger penetrates a case foot 47, 48. In this manner, the trigger is hidden to prevent its detection by a thief. Another trigger detonates the alarm 50 when the case 25 is moved. Yet another trigger detonates the alarm 50 if the case 25 is opened.

The alarm 50 uses a programmable alert system to protect the case. The alert system comprises several different signals that attract attention to the case 25 and instrument 30 when the alarm 50 is detonated.

One of the alerts is an audio signal, such as a bell or warning siren. The second alert is a visual signal, such as a strobe light or spotlight. The third alert is a silent alarm or homing beacon that uses radio waves to emit a signal.

A separate instrument trigger 52 detects movement of the instrument. This trigger independently detonates an instrument alert in alarm 50 when the instrument is removed from the case. When this trigger detonates the alarm 50, a separate audible alert is activated that attracts attention to the instrument itself.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An anti-theft instrument carrying case comprising:

a portable housing for protectively enclosing an instrument, said housing comprising an interior in which the instrument may be stored and transported;

a plurality of feet projecting from said housing for supporting said case upon a surface, said plurality of feet comprises a first cluster of feet projecting from a first portion of said case and a second cluster of feet projecting from a second portion of said case;

alarm means for warning when said case is disturbed or tampered with, said alarm means comprising:

a primary switch for setting the alarm means;

trigger means for detonating said alarm means if said primary switch has been set, said trigger means comprising at least one sensor coaxially disposed in at least one foot in said first cluster to form a first array and at least one sensor coaxially disposed in at least one foot in said second cluster to form a second array and programmable switch means for separately arming said first array and programmable switch means for separately arming said second array;

alert means responsive to said trigger means for attracting attention to said case; and, means for powering said alarm means.

2. The case as defined in claim 1 wherein said alert means comprises a sound generator and a strobe light.

3. The case as defined in claim 1 wherein said trigger means further comprises sensing means for detonating said alarm means when said instrument is removed from said case.

4. The case as defined in claim 1 wherein at least one of said sensors in said first and second arrays further comprises motion detection means for activating said alert means in response to case movement.

5. The case as defined in claim 1 wherein said alert means comprises beacon means for enabling the radio tracking of said case.

6. The case as defined in claim 1 further comprising delay means for isolating said alarm means from said primary switch until the passage of a preselected time interval.

7. The case as defined in claim 1 further comprising latch means for continuously activating said alert means until said primary switch is reset.

8. An anti-theft alarm for an instrument carrying case that alerts the owner if the case is moved or if the instrument is removed therefrom, said alarm comprising:

a primary switch for setting said alarm;

delay means for isolating said alarm from said primary switch until the passage of a preselected time interval;

trigger means for detonating said alarm if said primary switch has been set and said case is subsequently moved, said trigger means comprising two separately actuable arrays, each array comprising at least one sensor coaxially extending through a case foot, and programmable switch means for separately arming said arrays;

sensing means adapted to detonate said alarm if said primary switch has been set and said instrument is removed from said case;

programmable alert means for attracting attention to said case by using audio and/or visual signals, said alert means responsive to said trigger means;

a second alert means for signaling that the instrument has been removed from said case, said alert means responsive to said sensing means;

latch means for continuously activating both of said alert means until said primary switch is reset; and, means for powering said alarm.

9. The case as defined in claim 8 wherein at least one of said sensors further comprises motion detection means for activating said alert means in response to case movement.

* * * * *